US008522665B2

(12) United States Patent
Holt

(10) Patent No.: US 8,522,665 B2
(45) Date of Patent: Sep. 3, 2013

(54) PUMP WITH PIVOTING NEEDLE

(75) Inventor: Scott C. Holt, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1071 days.

(21) Appl. No.: 12/497,699

(22) Filed: Jul. 6, 2009

(65) Prior Publication Data

US 2011/0000364 A1 Jan. 6, 2011

(51) Int. Cl.
*F01B 31/00* (2006.01)

(52) U.S. Cl.
USPC ..... 92/58.1

(58) Field of Classification Search
USPC ..... 92/58.1
See application file for complete search history.

(56) References Cited

U.S. PATENT DOCUMENTS

| | | | |
|---|---|---|---|
| 5,551,848 | A | 9/1996 | Chuang et al. |
| 6,422,832 | B1 | 7/2002 | Wang |
| 6,558,129 | B2 | 5/2003 | Wang |
| 6,736,619 | B2 | 5/2004 | Wu |
| 7,086,211 | B2 | 8/2006 | Bassett et al. |
| 7,308,785 | B2 | 12/2007 | Bassett et al. |
| 2008/0053046 | A1 | 3/2008 | Bassett et al. |
| 2008/0056922 | A1 | 3/2008 | Huang |

*Primary Examiner* — F. Daniel Lopez
(74) *Attorney, Agent, or Firm* — Plumsea Law Group, LLC

(57) ABSTRACT

A hand pump with a rotatable portion of the pump head. The needle or adapter for attaching the pump to an inflatable is associated with the rotatable portion of the pump head so that the needle may be positioned in a first position for use and a second position for storage. The needle is protected by a sleeve when in the second position.

17 Claims, 14 Drawing Sheets

PUMP WITH PIVOTING NEEDLE

BACKGROUND

This application relates generally to pumps for inflating objects. In particular, the application describes a handheld pump with a needle that can be pivoted from a storage position to a use position.

Pumps are used to inflate a variety of different inflatable objects. Many pumps are hand-operated or foot-operated pumps for inflating bicycle tires, toys, and sports balls. While some pumps are designed for use in a specific location, such as in a home garage, basement, or the like, other pumps are intended to be transported with the user for use anywhere.

Pumps, particularly personal use pumps, generally use some type of adapter to connect the pump nozzle to the inflatable. Many pumps use slender needle-type adapters that are inserted into a valve on the inflatable for a secure, air-tight fit with the inflatable for efficient pumping. Many of these pumps are provided with different needles of varying sizes so that the pump can be used with a number of different inflatables with different valve sizes.

While the use of needle-type connectors are widely used, the needles themselves may be damaged when stored. The slender needles typically extend straight away from the pump head, so the needles are not protected from damage by any part of the pump. Due to the slender shape of the needle, the needle may be prone to bending or otherwise deforming when stored or transported in certain situations. For example, an athlete may transport and store a hand pump for a sports ball in a gym bag. The pump may not be secured within the bag, so the pump may move or bounce around, potentially damaging the needle and/or the location on the pump where the needle is attached. Also, additional items may be transported within the bag which may damage the needle or the pump when these additional items strike against or otherwise come into contact with the pump and needle.

As discussed above, some pumps are provided with interchangeable needle. With such pumps, the needles may be removed from the pump prior to storage or transportation to prevent damage to the needle and/or pump. However, such storage can be very inconvenient, as the use will need to reattach the needle to the pump prior to use. When the pump is always used to inflate the same inflatable, this can be extremely inconvenient. Further, the needles are relatively small, so the needles may be lost or damaged unless significant care is taken to secure the needles within the bag or other storage location.

Therefore, there exists a need in the art for a pump that protects the needle of the pump without removing the needle.

SUMMARY

A hand pump includes a needle for associating the pump with an inflatable object, such as a sports ball, an air mattress, a tire, or the like. The needle is movable from a storage position to a use position. The storage position includes positioning the needle within a sleeve that extends from an outer surface of the pump head. The needle is attached to a cylinder. The cylinder is slidably and rotatably associated with the pump head. To move the needle from the storage position to the use position, the needle is lifted out of the sleeve by sliding the cylinder with respect to the pump head and then rotated to the desired use position by turning the cylinder with respect to the pump head.

In one aspect, the invention provides a pump comprising a barrel containing a piston and a piston chamber, a head having a connector portion associated with the barrel, a cylinder rotatably associated with the connector portion, wherein the cylinder is in fluid communication with the piston chamber, a needle associated with and in fluid communication with the cylinder, wherein the needle is configured to attach the pump to an inflatable object, and a sleeve disposed on the connector portion, wherein the sleeve receives the needle when the head is in a storage position, wherein the cylinder is rotated to move the needle from the storage position to a use position.

In another aspect, the invention provides a head for a pump comprising a main body, a needle rotatably associated with the main body, and a sleeve associated with the main body, wherein the sleeve receives the needle when the head is in a storage position; and wherein the needle swivels to be removed from the sleeve.

In another aspect, the invention provides a pump comprising a barrel having a barrel length, the barrel defining a piston chamber, a piston slidably positioned within a piston chamber, a tubular element disposed within the piston chamber and extending the barrel length, wherein the tubular element defines a bore, wherein the bore is in fluid communication with the piston chamber. The pump also includes a head having a connector portion associated with the barrel, a cylinder rotatably associated with the connector portion, a spring disposed between the cylinder and the connector portion, wherein the spring holds the cylinder in position against the connector portion when the spring is in a neutral state. The cylinder is in fluid communication with the bore, a needle associated with and in fluid communication with the cylinder, wherein the needle is configured to attach the pump to an inflatable object, and a sleeve disposed on the connector portion, wherein the sleeve receives the needle when the head is in a storage position, wherein the cylinder is rotated to move the needle from the storage position to a use position, and wherein the piston slides within the pump to move air from the piston chamber into the inflatable object.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
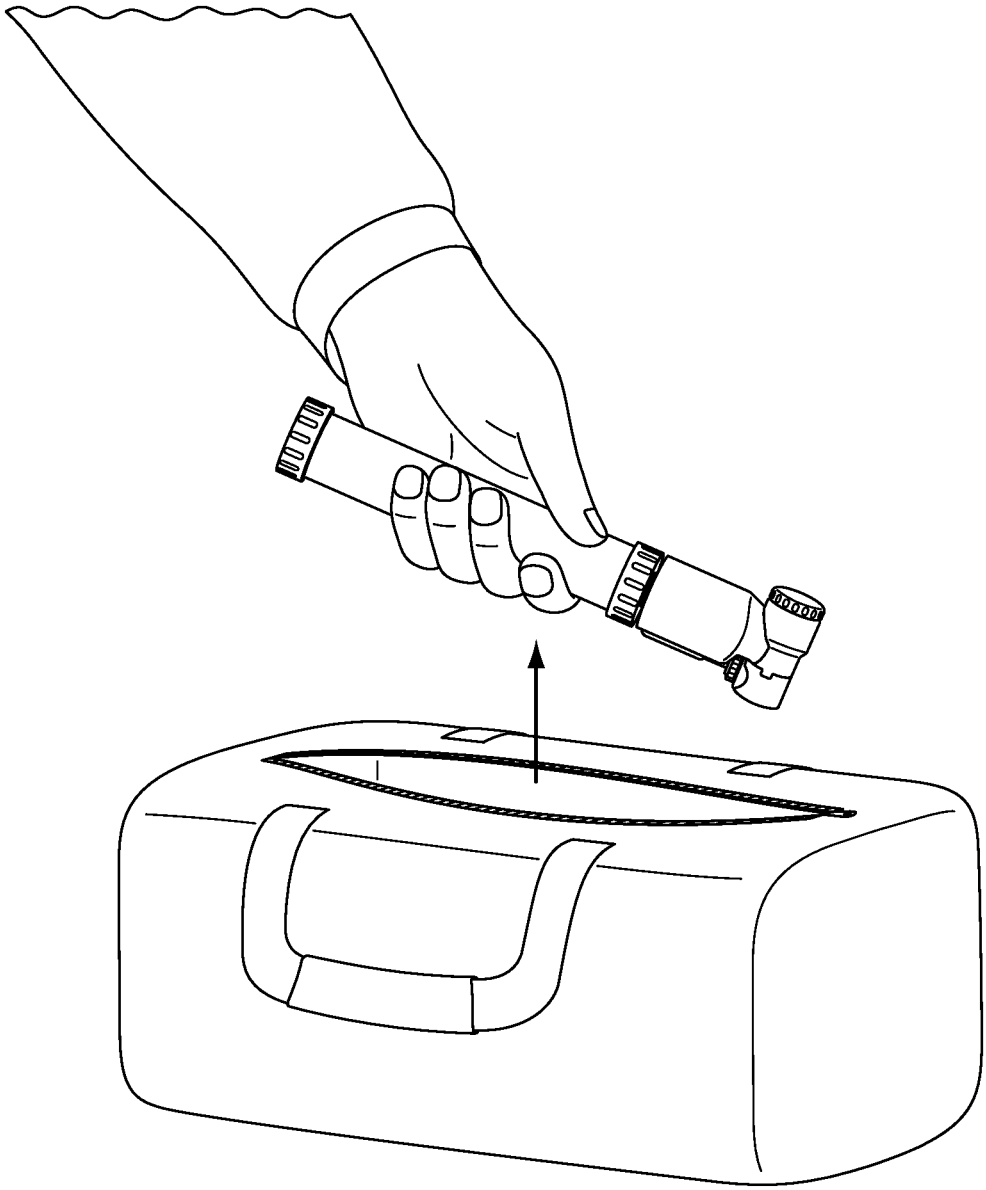
FIG. 1 is a schematic view of a user removing an embodiment of a pump from storage, with the needle of the pump in the storage position.
Figure 2:
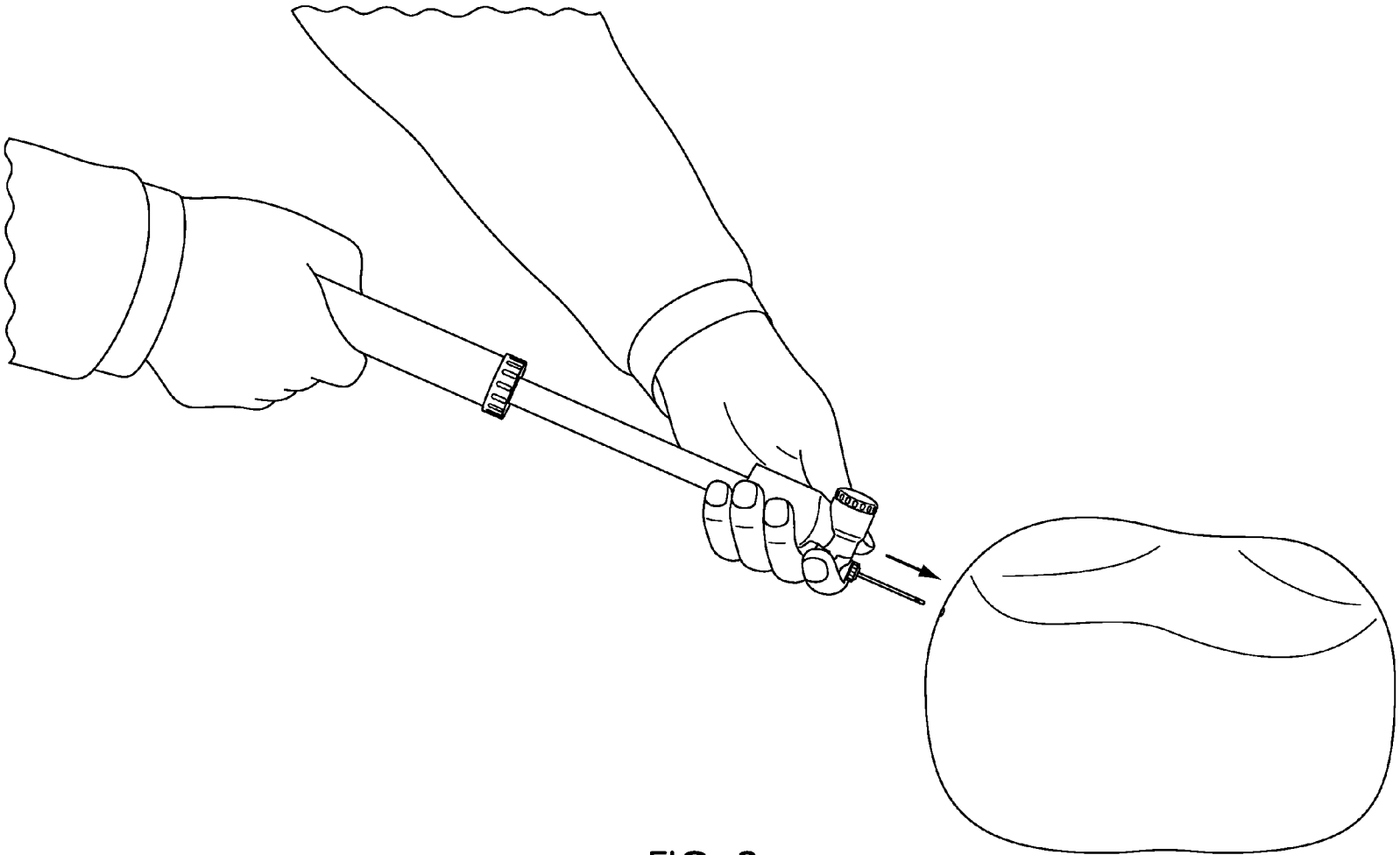
FIG. 2 is a schematic view of a user preparing to insert the needle of the pump in FIG. 1 into a ball, with the needle of the pump in the use position.

Embodiments of a pump having a storage configuration and a use configuration are described. FIG. 1 shows a scenario in which a pump would be used in the storage configuration, such as when a user wishes to transport the pump, for example in an equipment bag, without damaging the mechanism for attaching the pump to an inflatable. FIG. 2 shows a scenario in which the use configuration of the pump is desirable, such as when the user wishes to increase the air pressure within an inflatable, such as a sports ball. While generally used in this description to refer to a sports ball, "inflatable" may also refer to any type of inflatable object, including but not limited to toys such as beach balls, water crafts such as rafts, air crafts such as balloons, furniture such as mattresses and chairs, swimming pools, and the like.

Figure 3:
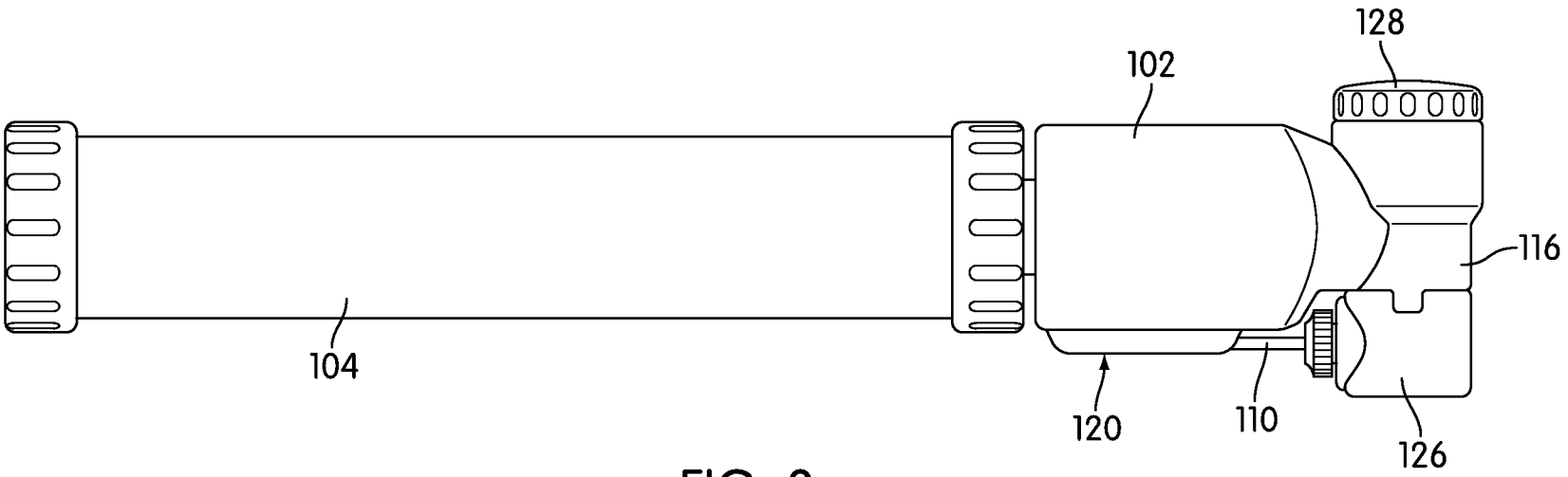
FIG. 3 is a plan view of an embodiment of a pump with a pivoting needle, where the needle of the pump is in the storage position.

FIG. 3 shows a pump 100 having both a storage configuration and a use configuration. In FIG. 3, pump 100 is in the storage configuration. Pump 100 generally includes a pump head 102 attached to and in fluid communication with a tubular element 106 (shown in FIG. 12) that is disposed within a barrel 104 when pump 100 is in a collapsed position. Barrel 104 generally includes the mechanism for compressing ambient air and starting the flow of the ambient air. Pump head 102 places pump barrel 104 in fluid communication with an inflatable. Pump head 102 generally includes provisions to attach pump 100 to an inflatable. Among these provisions to attach pump 100 to an inflatable is a needle 110.

Pump barrel 104 is generally configured to compress the ambient air to increase the pressure of the air within barrel 104 to begin the flow of the air from pump 100 into the inflatable. In some embodiments, such as those shown in the figures, pump 100 is generally configured to be a hand pump. As shown best in FIGS. 11-13, barrel 104 is relatively simple, including an exterior sleeve 131 that defines a piston chamber 103. A piston 101 is fixedly attached to a tubular element 106, which is concentric with and positioned within exterior sleeve 131. Tubular element 106 defines a barrel bore 108. Barrel bore 108 is in fluid communication with piston chamber 103 via an opening 105.

Opening 105 may include a one-way valve, such as a poppet valve, to control the direction of air flow, as air is desired only to flow from piston chamber 103 into barrel bore 108. When the one-way valve is open, air will flow between piston chamber 103 and barrel bore 108. The one-way valve may be set to open only when the pressure within piston chamber 103 reaches or exceeds a predetermined pressure.

Figure 4:
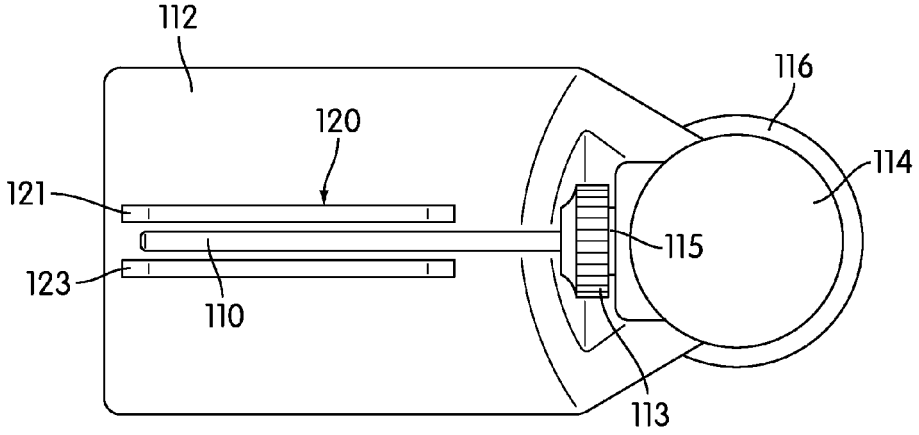
FIG. 4 is an enlarged top view of an embodiment of the head of a pump with the needle in the storage position.
Figure 5:
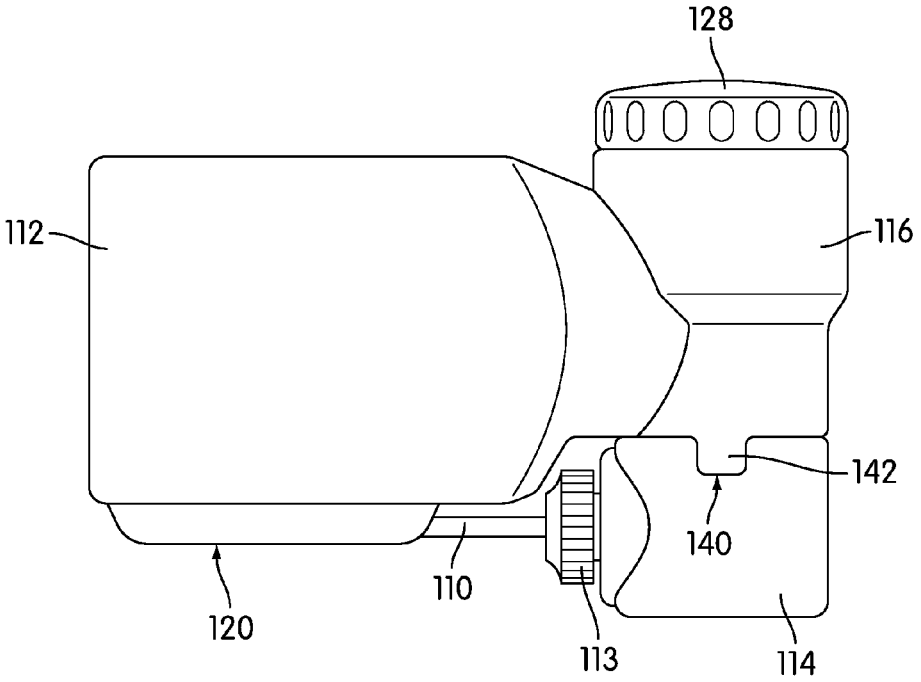
FIG. 5 is an enlarged side view of an embodiment of the head of a pump with the needles in the storage position.
Figure 11:
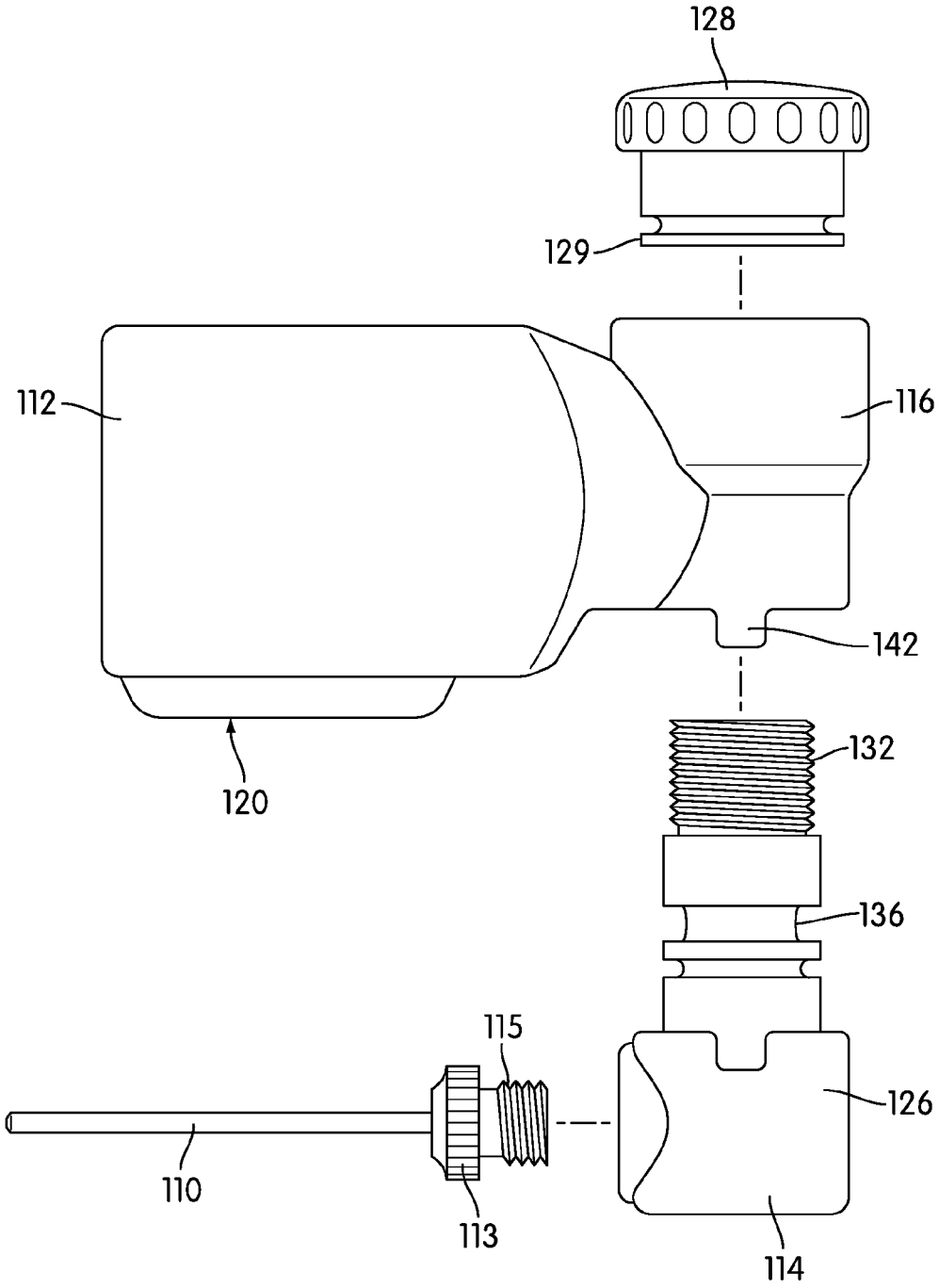
FIG. 11 is an exploded view of an embodiment of the head of a pump with a pivoting needle with the needle in the storage position.
Figure 12:
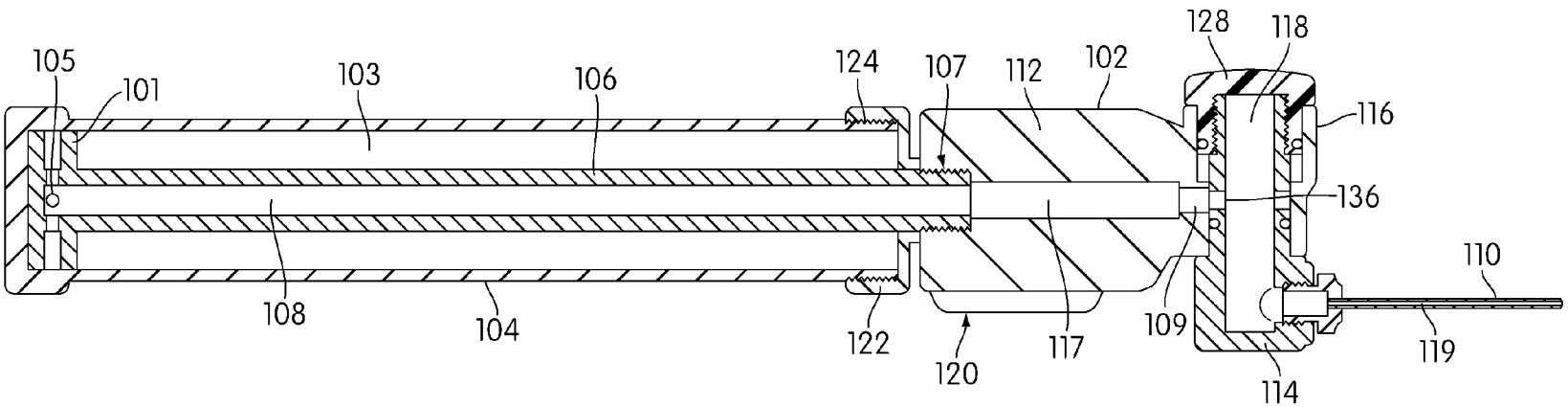
FIG. 12 is a cross-sectional view of an embodiment of a pump with a pivoting needle, with the needle in a use position and the pump in a collapsed position.
Figure 13:
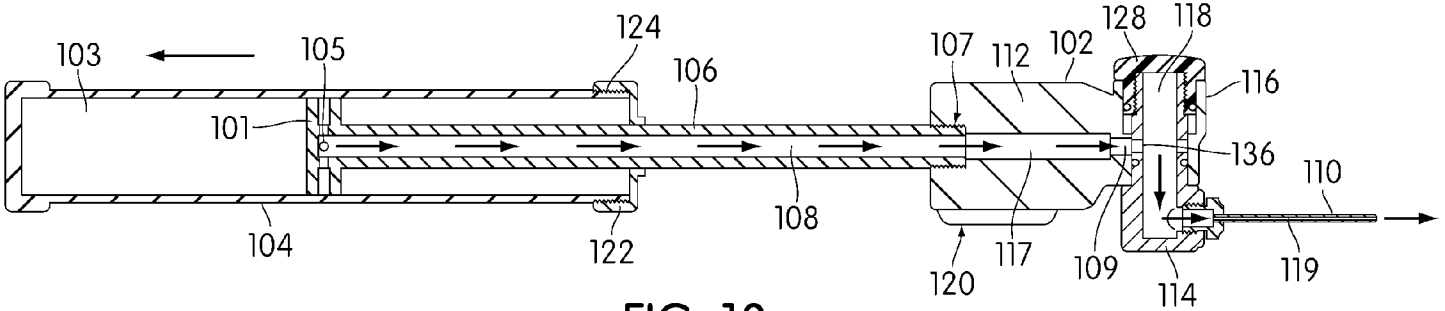
FIG. 13 is a cross-sectional view of an embodiment of a pump with a pivoting needle, with the needle in a use position and the pump in a fully extended position.

The pressurized air flows through barrel bore 108 into pump head 102. FIGS. 4 and 5 are an enlarged view of pump head 102 in the storage configuration. Pump head 102 generally includes a connector portion 112, a stem or cylinder 114, a stem or cylinder receiving portion 116, a needle 110, and a needle storage structure or sleeve 120. Internally, as is best shown in FIGS. 11-13, connector portion 112 defines a connector bore 117 that provides for fluid communication between barrel bore 108 and needle 110 so that the pressurized air from barrel 104 can flow into needle 110 and into the inflatable.

Connector portion 112 is sized and dimensioned to attach pump head 102 to barrel 104. Connector portion 112 may be any shape, but in the embodiment shown in the figures is substantially cylindrical. Connector portion 112 includes provisions to attach pump head 102 to barrel 104. Pump head 102 may be attached to barrel 104 in any manner that permits at least a portion of pump head 102 to be placed in fluid communication with a portion of barrel 104. In some embodiments, pump head 102 is attached by press fitting connector 112 to barrel 104. In some embodiments, as shown in FIGS. 11-13, pump head 102 is attached to barrel 104 by threading pump head 102 onto barrel 104 at threaded portion 107. In some embodiments, pump head 102 may be loosely fitted to barrel 104 and sealed with an adhesive. In some embodiments, to ensure a fluid-tight seal, sealing elements may be included in the region where pump head 102 and barrel 104 overlap. For example, adhesives, gaskets, O-rings, elastomeric sleeves, and the like may be positioned between or attached to one or both of pump head 102 and barrel 104.

Needle 110 may be any type of adapter configured to attach pump 100 to the inflatable to allow pressurized air to flow from pump 100 into the inflatable. In some embodiments, such as the embodiment shown in the figures, needle 110 is an elongated member that may be inserted into an inflation valve on the inflatable. The inflation valve may include seals to allow an airtight fit of needle 110 within the inflatable. In other embodiments, needle 110 may be configured to receive a portion of the inflatable within needle 110 to create the airtight fit. In some embodiments, as shown in FIG. 11, needle 110 may be removably attached to cylinder 114 at a needle receiving portion 126. Needle 110 may be attachable to needle receiving portion 126 using any method known in the art, but in some embodiments, needle 110 may include a needle threaded portion 115 that is configured to be threaded into a corresponding aperture in needle receiving portion 126. To assist in the attachment and removal of needle 110, a needle grip 113 may be provided proximate needle threaded portion 115. These provisions allow needle 110 to be interchangeably exchanged for different needle configurations so that pump 100 may be used with multiple types of inflatables, as many inflatables have different inflation valve designs.

Pump head 102 includes provisions to stow needle 110 when pump 100 is not in use without requiring removal of needle 110 from pump head 102. Needle 110 is associated with a cylinder 114. Cylinder 114 is associated with pump head 102 so that cylinder 114 may move with respect to pump head 102. In some embodiments, such as those shown in the figures, cylinder 114 is rotatably associated with pump head 102. In one embodiment, as shown in FIGS. 4-5, connector portion 112 includes a cylinder receiving portion 116. Cylinder receiving portion 116 is sized and shaped to accommodate cylinder 114. In some embodiments, cylinder receiving portion 116 is a hollow, substantially tubular element with a tubular inner bore having a diameter that is slightly larger than the outer diameter of cylinder 114 so that cylinder 114 may freely rotate within cylinder receiving portion 116.

Cylinder receiving portion 116 is positioned at the distal end of connector portion 112. In some embodiments, cylinder receiving portion 116 is integrally formed connector portion 112. In other embodiments, cylinder receiving portion 116 may be attached to connector portion 112 using any method known in the art, such as with an adhesive, welding, press-fitting, a mechanical connector, or the like.

Figure 7:
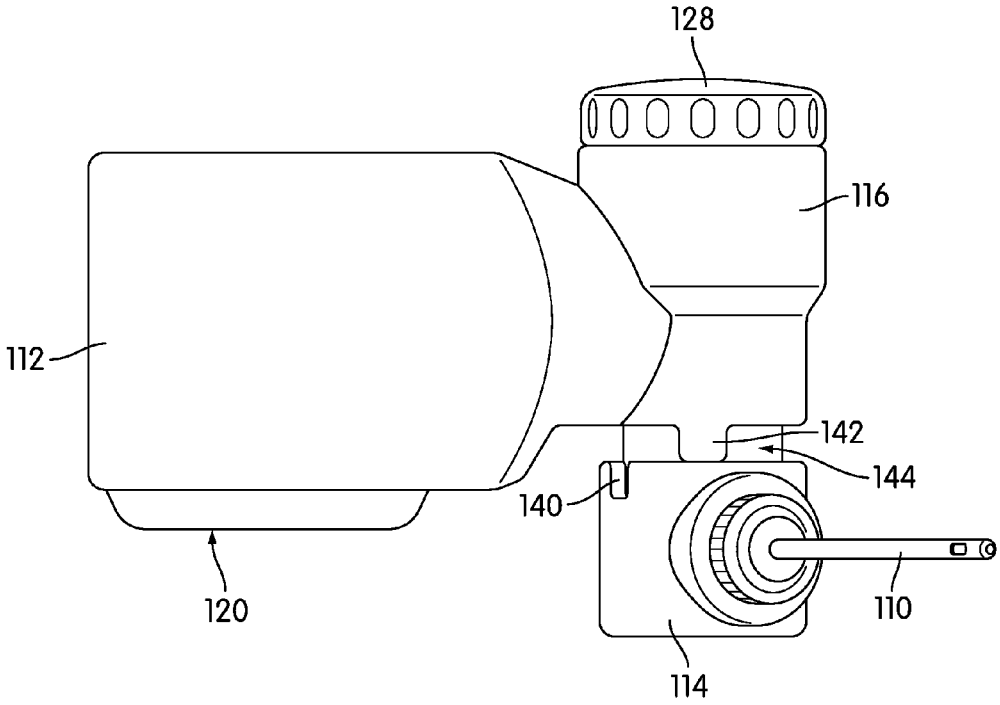
FIG. 7 is an enlarged side view of an embodiment of the head of a pump with the needle being rotated from the storage position to the use position.

Because cylinder receiving portion 116 may be sized and shaped so that cylinder 114 may freely rotate within cylinder receiving portion 116, pump head 102 includes provisions to fix cylinder 114 into a particular position. In some embodiments, for example, a securing element 128 may be provided. Securing element 128 may take any form known in the art, such as a latch, a pin, or the like. In some embodiments, such as those shown in the figures, securing element 128 may be a cap removably attachable to cylinder 114. Securing element 128 has a loosened position, as shown in FIG. 7, where a gap 144 is present between the bottom of cylinder receiving portion 116 and needle receiving portion 126 of cylinder 114. Securing element 128 also has a tightened position, as shown in FIG. 5, where gap 144 is not present and the bottom of cylinder receiving portion 116 presses against needle receiving portion of cylinder 114.

To tighten and loosen securing element 128, securing element 128 may be provided with a mechanical attachment to cylinder 114. For example, as best shown in FIG. 11, cylinder 114 may include a threaded portion 132. Securing element 128 may include a corresponding threaded portion. Tightening securing element 128 onto threaded portion 132 of cylinder 114 pushes securing element 128 against an internal shoulder of cylinder receiving portion 116 and needle receiving portion 126 of cylinder 114 against a lower end of cylinder receiving portion 116. When sufficiently tightened, securing element 128 and cylinder 114 will press against cylinder receiving portion 116 with sufficient force so that turning cylinder 114 is inhibited. Loosening securing element 128 by turning securing element 128 to release corresponding threaded portion from threaded portion 132 positions securing element 128 and needle receiving portion 126 of cylinder 114 further away from cylinder receiving portion 116 so that gap 144 (as shown in FIG. 7) is once again present between cylinder receiving portion 116 and cylinder 114 so that cylinder 114 may again rotate within cylinder receiving portion 116.

Figure 6:
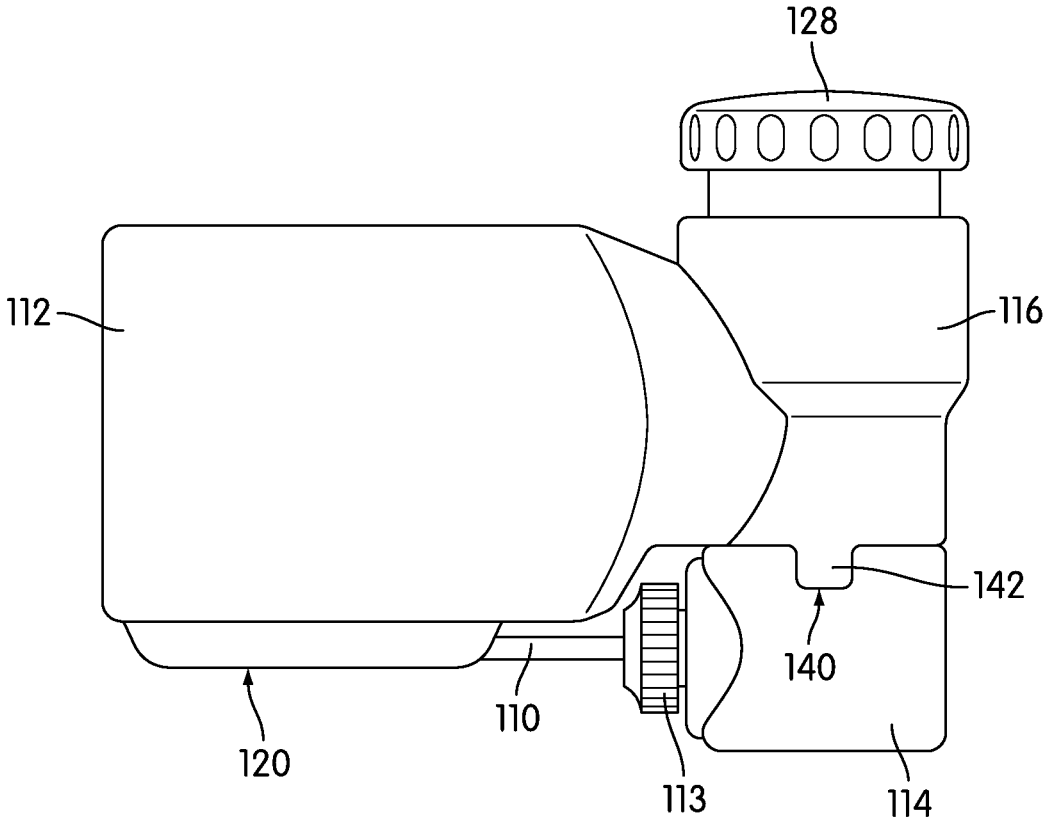
FIG. 6 is an enlarged side view of an embodiment of the head of a pump with the needle in the storage position and the head pump in an unlocked position.

Pump head 102 may also include other provisions to secure cylinder 114 into a specific position. Additionally, pump head 102 may include provisions that allow cylinder 114 to be positioned with specificity. For example, as shown in FIGS. 5 and 6, cylinder 114 may include a notch 140. Notch 140 is sized and dimensioned to receive a tab 142 associated with cylinder receiving portion 116. In some embodiments, notch 140 may be mirrored on the opposite side of cylinder 114 and tab 142 may be mirrored on the opposite side of cylinder receiving portion 116 so that two notches 140 and two tabs 142 are provided.

As shown in FIG. 5, when tab 142 is aligned with notch 140, tab 142 may be inserted into notch 140. When used in conjunction with securing element 128, cylinder 114 may be secured into position. When tab 142 is inserted into notch 140, cylinder 114 will not be able to rotate within cylinder receiving portion 116 as tab 142 abuts against the sides of notch 140 when attempts are made to turn cylinder 114. As will be recognized by those in the art, in some embodiments, tab 142 may be positioned on cylinder 114 and notch 140 may be positioned on cylinder receiving portion 116.

Tab 142 and notch 140 may be positioned on cylinder receiving portion 116 and cylinder 114 so that a specific position of cylinder 114 within cylinder receiving portion 116 may be easily achieved. In other words, tab 142 and notch 140 may act as a guide for positioning cylinder 114. Placing cylinder 114 into a specific position may be desirable, such as when the flow path through pump 100 is only fully developed when cylinder 114 is in a specific position. For example, as shown best in FIGS. 11-13, the flow path through pump 100 includes various segments in different pieces of pump 100. The flow path begins within barrel 104, with bore 108 in tubular element 106. Bore 108 is in fluid communication with connector bore 117 in connector element 112. Connector bore 117 terminates at a bore mouth 109 positioned proximate cylinder 114. A flow aperture 136 is formed in cylinder 114 to provide fluid communication between connector bore 117 and a cylinder bore 118 when bore mouth 109 and flow aperture 136 are aligned. Cylinder bore 118 is in fluid communication with a needle bore 119 that leads to a needle aperture 111 (shown in FIG. 10). Needle aperture 111 is configured to allow the air from pump 100 to exit the flow path of pump 100 and flow into the inflatable.

In some embodiments, flow aperture 136 may be relatively small so that the flow path of pump 100 is fully developed, i.e., all portions of the flow path are in fluid communication with each other, when cylinder 114 is positioned in a specific orientation with respect to cylinder receiving portion 116. Tab 142 and notch 140 may be positioned so that the user may easily select the appropriate position to fully develop the flow path and also secure cylinder 114 into position when the flow path has been fully developed, i.e., flow aperture 136 has been aligned with bore mouth 109. Notably, when flow aperture 136 is not aligned with bore mouth 109, the flow path is blocked by the body of cylinder 114 and air will not flow through pump 100.

Figure 8:
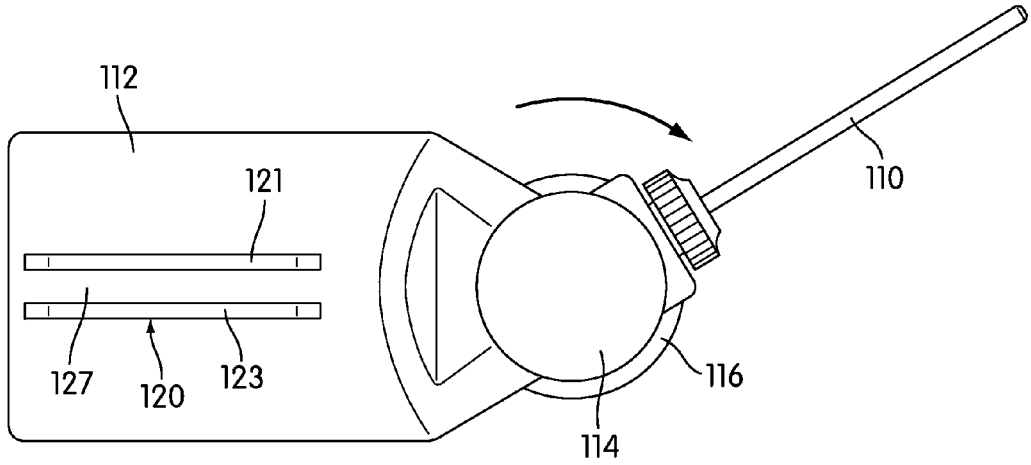
FIG. 8 is an enlarged top view of an embodiment of the head of a pump with the needle being rotated from the storage position to the use position.
Figure 9:
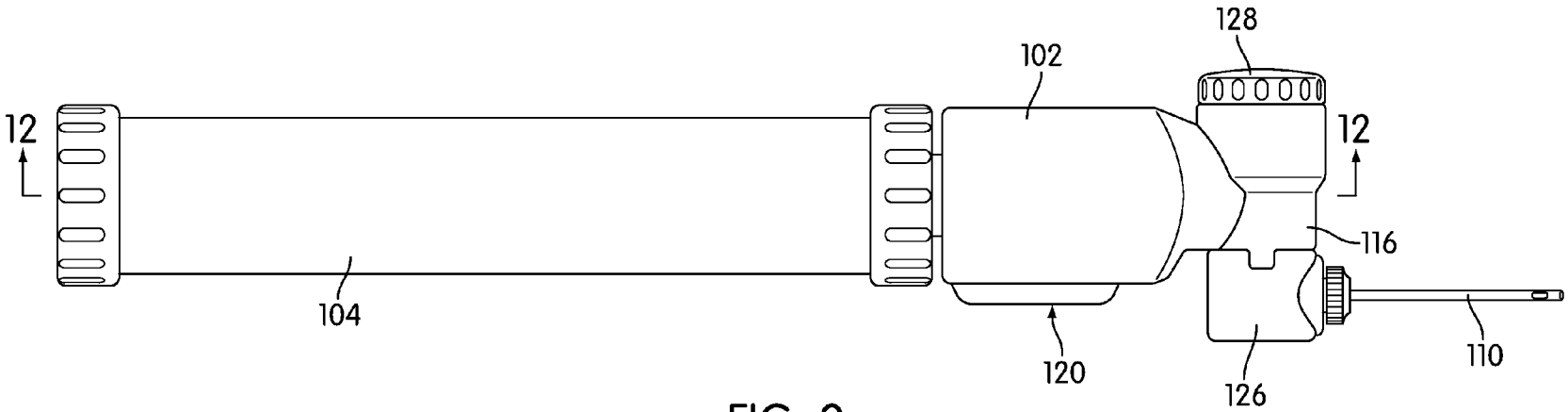
FIG. 9 is a plan view of an embodiment of a pump with a pivoting needle with the needle in the use position.

Pump head 102 may also include provisions to allow needle 110 to be stored in a protected fashion when pump 100 is not in use. FIGS. 3-5 show pump 100 and/or pump head 102 in the storage position, where needle 110 is positioned proximate connector portion 112. Pump head 102 also includes provisions to swivel needle 110 from the storage position to a use position. FIG. 9 shows pump 100 in the use position, and FIGS. 7-8 show intermediate positions for pump 100/pump head 102. In FIGS. 3-6, needle 110 is positioned within a sleeve 120 that includes first wall 121 and second wall 123 that extend away from the surface of connector portion 112. In other embodiments (not shown), sleeve 120 may be recessed into connector portion 112, so that first wall 121 and second wall 123 extend into connector portion 112 from the outer surface of connector portion 112. Sleeve 120 protects needle 110 from damage during storage. Sleeve 120 also assists in maintaining the storage position of needle 110, as first wall 121 and second wall 123 impede the movement of needle 110.

To change needle 110 from the storage position, which is shown in FIGS. 3-6, to the use position, which is shown in FIGS. 9-10 and 12-14, needle 110 may be rotated away from connector portion 112 to extend away from pump head 102. Because first wall 121 and second wall 123 may have a height that extends away from the surface of connector portion 112 a certain distance, needle 110 may be lifted away from the surface of connector portion 112 a sufficient distance so as to clear first wall 121 and second wall 123. Lifting needle 110 away from the surface of connector portion 112 may be achieved by providing cylinder 114 with a length sufficient to extend beyond the entire width of connector portion 112, where the amount that cylinder 114 extends beyond the width of connector portion 112 is equal to or greater than the height of first wall 121 and second wall 123.

As shown in FIG. 6, securing element 128 may be loosened so that securing element 128 is lifted away from the shoulder of cylinder receiving portion 116. As shown in FIG. 7, when securing element 128 is loosened, cylinder 114 extends away from cylinder receiving portion 116 to create gap 144. In other words, securing element 128 may be loosened to increase the effective length of cylinder 114. Because cylinder 114 and cylinder receiving portion 116 are sized so that cylinder 114 may fit loosely within cylinder receiving portion 116, cylinder 114 may move within cylinder receiving portion 116. The movement of cylinder 114 within and with respect to cylinder receiving portion 116 may be to move needle receiving portion 126, the base of cylinder 114, closer to or further away from cylinder receiving portion 116 by sliding or translating cylinder 114 within cylinder receiving portion 116. Moving needle receiving portion 126 away from cylinder receiving portion 116 moves needle 110 away from the surface of connector portion 112. Moving needle receiving portion 126 away from cylinder receiving portion 116 also lifts tab 142 out of notch 140 in embodiments provided with tab 142 and notch 140. In these embodiments, tab 142 may have a length similar to the height of first wall 121 and second wall 123 so that cylinder 114 may be translated within cylinder receiving portion 116 a similar distance to allow needle 110 to clear first wall 121 and second wall 123 and to allow tab 142 to clear notch 140.

The movement of cylinder 114 within and with respect to cylinder receiving portion 116 may be rotational to alter the orientation of needle 110 with respect to pump head 102. Following the sequence shown in FIGS. 5-8, cylinder 114 may be positioned initially within cylinder receiving portion 116 at a first angle of orientation so that needle 110 is positioned within sleeve 120 and tab 142 is inserted into notch 140. This initial position is shown in FIG. 5.

FIGS. 7 and 8 show the position of needle 110 once the angle of orientation of cylinder 114 with respect to cylinder receiving portion 116 has been shifted. Cylinder 114 has been translated within cylinder receiving portion 116 as described above so that needle 110 has been lifted out of sleeve 120 and tab 142 has been lifted out of notch 140. Cylinder 114 has also been rotated within cylinder receiving portion 116 so that cylinder 114 has a second angle of orientation with respect to cylinder receiving portion 116.

Cylinder 114 has been rotated in the direction indicated by the arrow in FIG. 8. In some embodiments, the rotational direction of cylinder 114 may be in only one direction to move needle 110 from the storage position to the use position, such as when stops or threading is used to control the direction of motion. When rotating cylinder 114 in the opposite direction, needle 110 may be moved from the use position to the storage position. For example, in some embodiments, rotating cylinder 114 is a clockwise direction may alter the position of needle 110 from the storage to the use position while turning cylinder 114 in the counterclockwise direction may alter the position of needle 110 from the use position to the storage position. In other embodiments, the rotational direction of cylinder 114 is not fixed, and cylinder 114 may be rotated either clockwise or counterclockwise to alter the position of needle 110 from the storage position to the use position or vice versa.

Figure 10:
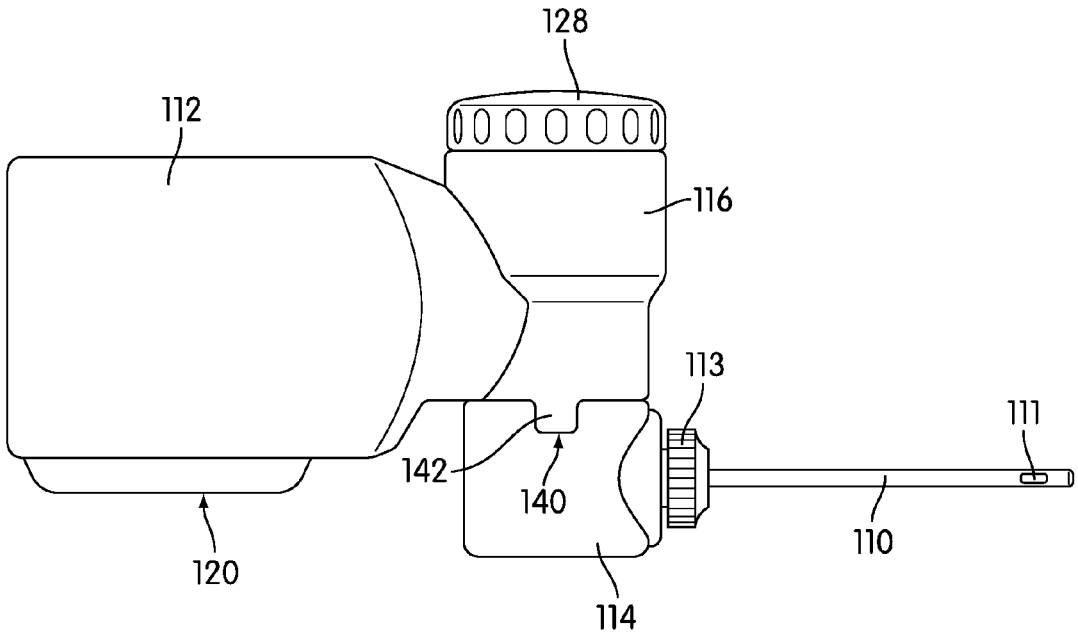
FIG. 10 is an enlarged side view of an embodiment of the head of a pump with a pivoting needle with the needle in the use position.

Once needle 110 has been extended fully away from pump head 102, as shown in FIGS. 9 and 10, securing element 128 may be tightened to cause needle receiving portion 126 to abut the bottom of cylinder receiving portion 116. In other words, tightening securing element 128 so that securing element 128 rests on cylinder receiving portion 116 shortens the effective length of cylinder 114. In some embodiments where two notches 140 and two tabs 142 are provided on opposite sides of cylinder 114 and cylinder receiving portion 116, tab 142 may be aligned with notch 140 so that the angular position of cylinder 114 with respect to cylinder receiving portion 116 is carefully selected.

Figure 14:
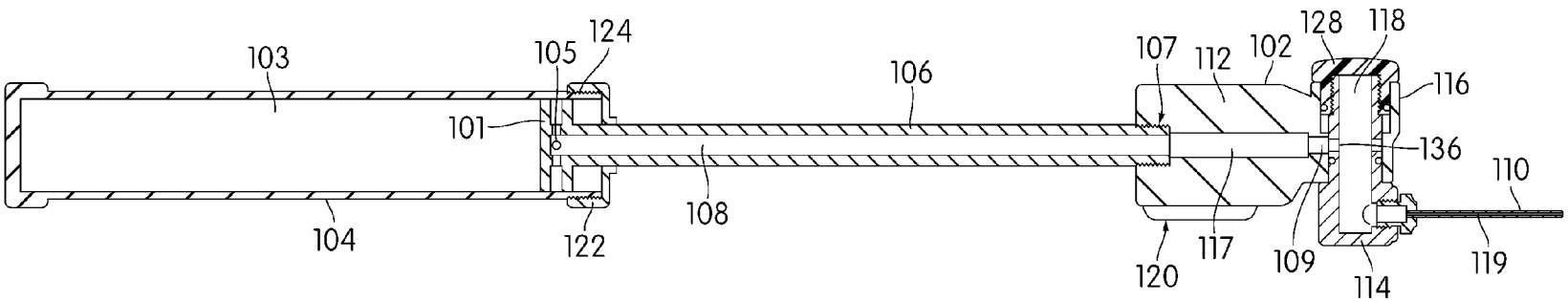
FIG. 14 is a cross-sectional view of an embodiment of a pump with a pivoting needle, with the needle in a use position and the pump in a pumping position.
Figure 15:
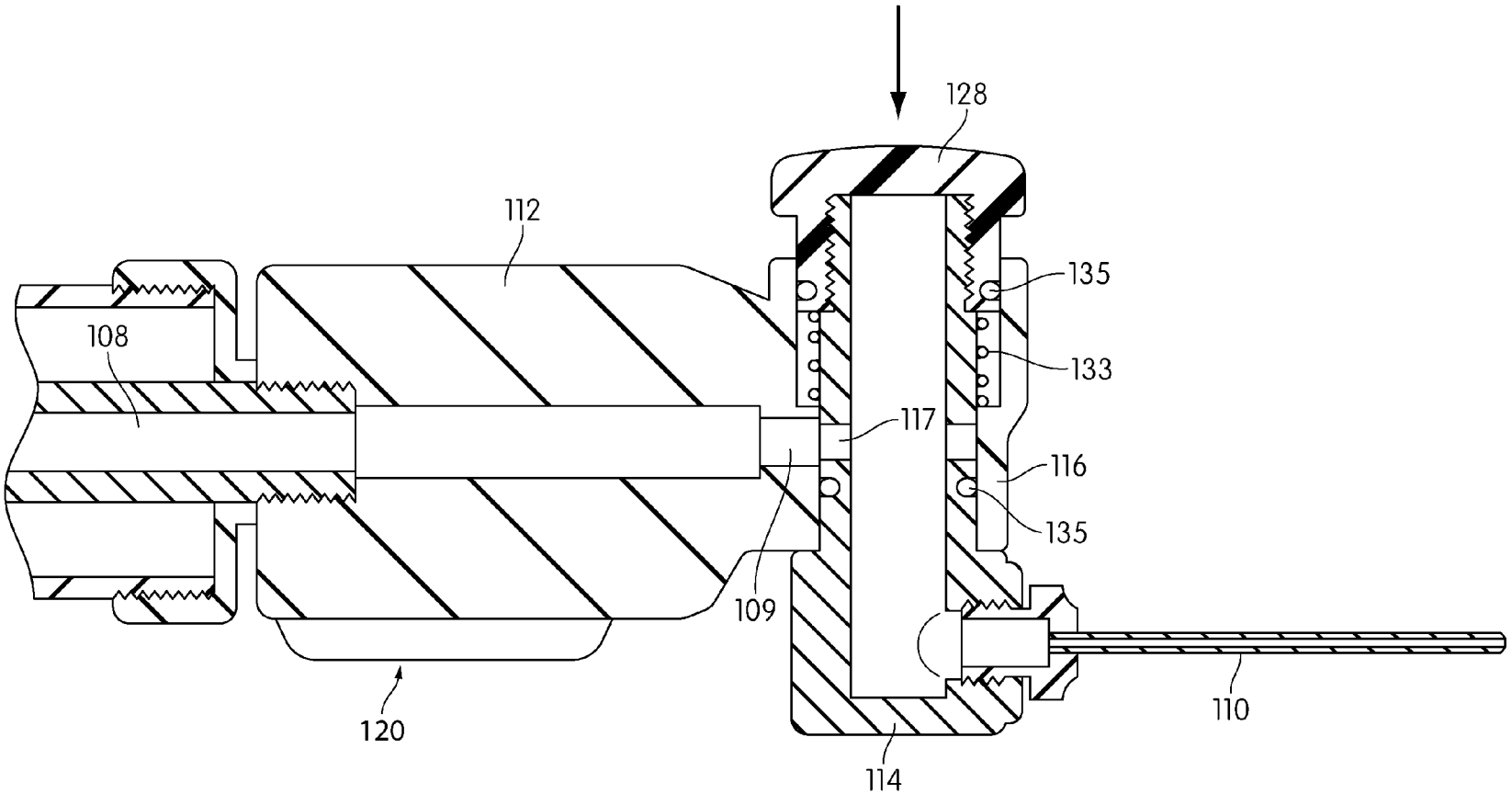
FIG. 15 is a cross-sectional view of an embodiment pump head where the needle carrier is spring-loaded, and the needle carrier is locked to hold the needle in a use position.
Figure 16:
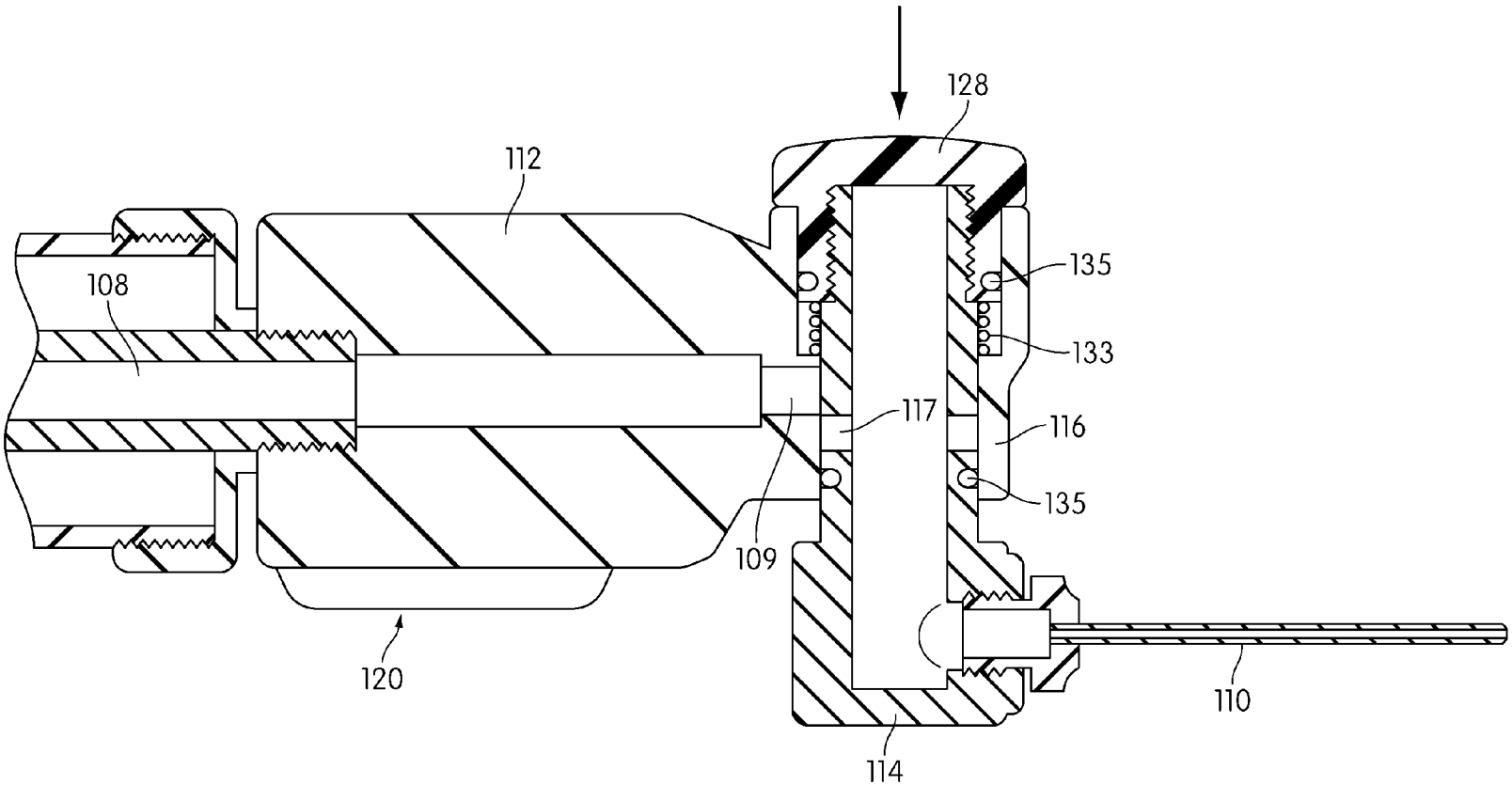
FIG. 16 is a cross-sectional view of an embodiment of a pump head where the needle carrier is spring-loaded, and the needle carrier is depressed to unlock the needle carrier so that the needle may be rotated.
Figure 17:
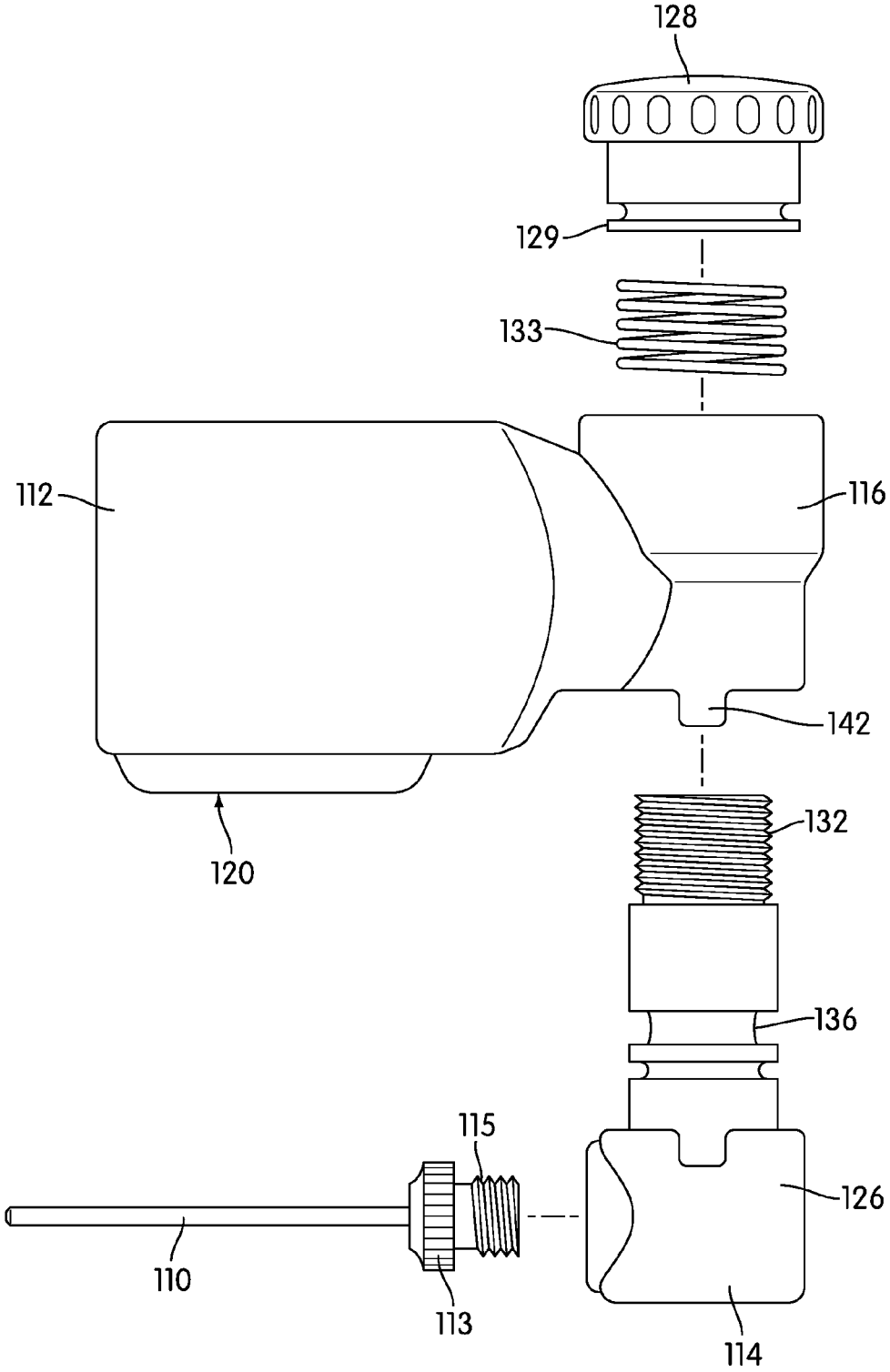
FIG. 17 is an exploded view of an embodiment of a pump head with a spring-loaded needle carrier.

In another embodiment, shown in FIGS. 15-17, cylinder 114 is spring-loaded so that securing mechanism 128 need not be tightened or loosened to lock and unlock cylinder 114 for rotation within cylinder receiving portion 116. In all other respects, this embodiment is structurally similar to the embodiment shown in FIGS. 3-14.

As shown in FIG. 15, cylinder 114 is positioned within cylinder receiving portion 116 with a spring 133 positioned in a gap between an outside wall of cylinder 114 and an inside wall of cylinder receiving portion 116. As shown best in FIG. 17, spring 133 may be a coil spring. In other embodiments, spring 133 may be any type of spring known in the art, such as a leaf spring. Spring 133 is positioned so that an upper end of spring abuts a lower end 129 of securing mechanism 128, which is threaded onto cylinder 114. A lower end of spring 133 is positioned against a floor of the cavity defining the gap between cylinder 114 and cylinder receiving portion 116.

In a neutral state, spring 133 is fully extended so that securing mechanism 128 is biased away from cylinder receiving portion 116. In this position, the lower end of cylinder 114, needle receiving portion 126 (FIG. 17), is pressed against the lower end of cylinder receiving portion 116. The abutment of cylinder 114 against cylinder receiving portion 116 prevents cylinder 114 to turn within cylinder receiving portion 116. Additionally, in this configuration, as shown in FIG. 6, tab 142 may be inserted into slot 140 to further lock cylinder 114 in position with respect to cylinder receiving portion 116.

To allow cylinder 114 to rotate within cylinder receiving portion 116, needle receiving portion 126 is moved away from the lower end of cylinder receiving portion 116. Also, optional tab 142 is lifted out of slot 140. This is achieved in some embodiments by pushing against securing element 128, such as with the finger(s) or hand(s) of the user, in the direction indicated by the arrow in FIG. 15. As shown in FIG. 16, this motion translates cylinder 114 within cylinder receiving portion 116 so that needle receiving portion is moved away from the lower end of cylinder 114. At this point, cylinder 114 is free to rotate within cylinder receiving portion 116 so that needle 110 may be positioned as desired by the user.

The pressing force that translates cylinder 114 within cylinder receiving portion 116 also compresses spring 133 and stores restorative energy within spring 133. When the user ceases pushing against securing element 128, the restorative energy in spring 133 is released. Spring 133 regains its original length, thereby pushing securing element 128 away from cylinder receiving portion 116. This restores the pump head to the locked position where cylinder 114 is unable to be rotated with respect to cylinder receiving portion 116.

This is particularly desirable in embodiments where flow aperture 136 (shown in FIGS. 12-14) is relatively small so that the flow path is completed only when flow aperture 136 is fully aligned with bore mouth 109. The alignment of flow aperture 136 and bore mouth 109 may, in some embodiments, only occur when cylinder 114 is in a particular angular orientation with respect to cylinder receiving portion 116. The positions of tab 142 and notch 140 may be selected so that tab 142 and notch 140 only align when flow aperture 136 and bore mouth 109 are also in alignment. This may assist the user in readily selecting the use position.

In other embodiments, however, flow aperture 136 may be relatively large so that cylinder 114 may be positioned at several different angles of orientation with respect to cylinder receiving portion 116 and still have a fully developed flow path. These embodiments may not utilize tab 142 and notch 140. In some embodiments, needle 110 may be in the use position in any position other than when positioned inside sleeve 120. For example, it may be desirable to allow for needle 110 to be substantially perpendicular to pump head 102 in the use position or at any angle with respect to pump head 102. This flexibility in the use position may be desirable when pump 100 may be used in situations with little clearance room around the inflatable, such as when inflating a bicycle tire or when inflating a sports ball in a vehicle.

To place needle 110 back into the storage position, securing element 128 is loosened to allow cylinder 114 to rotate within and with respect to cylinder receiving portion 116. Cylinder 114 is then rotated so that needle 110 is aligned with sleeve 120 and, optionally, tab 142 is aligned with notch 140. Cylinder 114 is then translated within and with respect to cylinder receiving portion 116 so that needle 110 is inserted into sleeve 120 and, optionally, tab 142 is inserted into notch 140. Securing element 128 may then be tightened to eliminate gap 144 to maintain the storage position of needle 110 within sleeve.

FIGS. 11-13 show a sequence of how pump 100 may be used to inflate an inflatable. As shown, in order to allow air to flow entirely through pump 100 and into the inflatable (not shown), pump head 102 is set to the use position. In other words, needle 100 is fully extended away from connector portion 112, and stem 114 has been rotated so that flow aperture 136 is aligned with bore mouth 109 to completely open the flow path from tubular element 106 to needle 110.

Pump 100 may begin the pumping process in the position shown in FIG. 12. In this position, tubular element 106 is nearly completely inserted into barrel 104 so that a first end of barrel 104 is positioned proximate to pump head 102. Piston 101 is positioned proximate the opposite end, or rear end, of barrel 104, and valve 105 is closed because no pressure is being applied to valve 105 in order to open valve 105. In this position, no air flows through tubular element into pump head 102.

FIG. 13 shows an intermediate position in pumping, where barrel 104 has been drawn back so that tubular element 106 is at least partially exposed. In FIG. 13, tubular element 106 is almost fully exposed and piston 101 is positioned proximate the first end of barrel 104. Barrel 104 now holds a volume of air within piston chamber 103. No air is flowing, however, and valve 105 is still in the closed position.

FIG. 14 shows pump 100 during the pump stroke. Barrel 104 is being pushed toward pump head 102. Due to this movement, piston 101 is pushed toward the rear end of barrel 104, compressing the volume of air within piston chamber 103. As the air is compressed, the pressure of the air within piston chamber 103 rises. Once the pressure of the air within piston chamber 103 exceeds the threshold pressure for opening valve 105, valve 105 opens and the air begins to flow Air flows through bore 108 and into connector bore 117. The air flows through connector bore 117 and into cylinder bore 118 as long as bore mouth 109 is aligned with flow aperture 136. The air then flows through cylinder bore 118 and into needle bore 119. Finally, the air flows through needle bore 119 and out of needle 110 through needle aperture 111 (as shown in FIG. 10) and into the inflatable (not shown.)

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A pump comprising:

a barrel containing a piston and a piston chamber;

a head having a connector portion associated with the piston;

a cylinder rotatably associated with the connector portion, wherein the cylinder is in fluid communication with the piston chamber;

a needle associated with and in fluid communication with the cylinder, wherein the needle is configured to attach the pump to an inflatable object;

a needle storage structure disposed on the connector portion, wherein the sleeve receives the needle when the needle is in a storage position;

wherein the needle storage structure includes two sidewalls, wherein the sidewalls have sufficient height to prevent the needle from rotating so that the needle is lifted to clear the sidewalls prior to rotating, and wherein the cylinder is rotated to move the needle from the storage position to a use position.

2. The pump according to claim 1 further comprising a spring positioned between the cylinder and the connector portion.

3. The pump according to claim 1, wherein the cylinder includes a locking mechanism.

4. The pump according to claim 3, wherein the locking mechanism comprises a tab disposed on the connector portion and a slot disposed on the cylinder, wherein slot is configured to receive the tab.

5. The pump according to claim 4 further comprising a flow aperture on the cylinder and a bore mouth on the connector portion, wherein the flow aperture is aligned with the bore mouth to complete a flow path from the barrel to the needle.

6. The pump according to claim 5, wherein rotating the cylinder to align the tab and the notch aligns the flow aperture with the bore mouth.

7. The pump according to claim 3, wherein the locking mechanism comprises a cap removably attachable to the cylinder, wherein the cap is tightened to the connector portion to bring the connector portion into contact with the cylinder and prevent the cylinder from rotating, and wherein the cap is loosened so that the cylinder is free to rotate.

8. A pump comprising:

a main body, wherein the main body includes a first portion having a uniform outer surface and a needle storage structure associated with the first portion; and a needle rotatably associated with the main body;

wherein the needle storage structure receives the needle when the needle is in a storage position;

wherein the needle storage structure includes a first wall and a second wall;

wherein the first wall and the second wall extend away from the uniform outer surface, and wherein the needle swivels to be removed from the needle storage structure.

9. The pump according to claim 8, wherein the needle is associated with a cylinder rotatably associated with the main body.

10. The pump according to claim 9, wherein the cylinder is positioned within a tubular element associated with the main body, and wherein the cylinder is configured to slide within the tubular element and to rotate within the tubular element.

11. The pump according to claim 10, further comprising a securing element associated with the cylinder, wherein the securing element prevents the cylinder from moving with respect to the tubular element in a first configuration and allows the cylinder to move with respect to the tubular element in a second configuration.

12. The pump according to claim 10, wherein the pump is a hand pump.

13. A pump comprising:

a barrel having a barrel length, the barrel defining a piston chamber;

a piston slidably positioned within a piston chamber;

a tubular element disposed within the piston chamber, wherein the tubular element defines a bore;

wherein the bore is in fluid communication with the piston chamber;

a head having a connector portion associated with the tubular element;

a cylinder rotatably associated with the connector portion, wherein the cylinder is in fluid communication with the bore;

a spring disposed between the cylinder and the connector portion, wherein the spring holds the cylinder in position against the connector portion when the spring is in a neutral state;

a needle associated with and in fluid communication with the cylinder, wherein the needle is configured to attach the pump to an inflatable object; and a needle storage structure disposed on the connector portion, wherein the needle storage structure receives the needle when the needle is in a storage position;

wherein the cylinder is rotated to move the needle from the storage position to a use position; and wherein the piston slides within the pump to move air from the piston chamber into the inflatable object.

14. The pump according to claim 13, wherein the needle is lifted from the needle storage structure by sliding the cylinder with respect to the connector portion, and wherein the needle is rotated from the storage position to the use position by rotating the cylinder with respect to the connector portion.

15. The pump according to claim 13 further comprising a cap associated with the cylinder, wherein pushing the cap translates the cylinder within the connector portion to compress the spring and unlock the cylinder so that the cylinder can be rotated within the connector portion.

16. The pump according to claim 13, further comprising a tab disposed on one of the cylinder or the connector portion and a slot disposed on the other of the cylinder or the connector portion, wherein slot is configured to receive the tab.

17. The pump according to claim 13 further comprising a flow aperture on the cylinder and a bore mouth on the connector portion, wherein the flow aperture is aligned with the bore mouth to complete a flow path from the barrel to the needle.

* * * * *